United States Patent [19]

DeRemer

[11] 4,166,994

[45] Sep. 4, 1979

[54] THERMOSTAT WITH POSITIVE OFF POSITION

[75] Inventor: Harold A. DeRemer, Allentown, Pa.

[73] Assignee: General Electric Company, New York, N.Y.

[21] Appl. No.: 862,351

[22] Filed: Dec. 20, 1977

[51] Int. Cl.[2] ..... H01H 37/52

[52] U.S. Cl. ..... 337/350; 337/82; 337/353; 337/361

[58] Field of Search ..... 337/350, 353, 360, 361, 337/67, 68, 82, 85, 374

[56] References Cited

U.S. PATENT DOCUMENTS

| | | | |
|---|---|---|---|
| 1,985,100 | 12/1934 | Kuhn et al. | 200/138 |
| 2,020,538 | 12/1935 | Denison | 200/138 |
| 2,071,209 | 2/1937 | Kuhn et al. | 200/39 |
| 2,567,138 | 9/1951 | Weiland | 219/25 |
| 2,597,700 | 5/1952 | Beach | 219/25 |
| 2,768,263 | 10/1956 | Callihan | 200/138 |
| 2,824,192 | 2/1958 | Marmo | 200/122 |
| 3,270,169 | 8/1966 | Altemiller | 200/138 |
| 3,354,278 | 11/1967 | Piacent et al. | 337/67 X |
| 3,358,101 | 12/1967 | Bletz | 200/139 |
| 3,421,131 | 1/1969 | Moyer et al. | 337/338 |
| 3,462,722 | 8/1969 | Bletz | 337/347 |
| 3,617,973 | 11/1971 | Chesnut | 337/375 |
| 3,680,021 | 7/1972 | Holtkamp | 337/312 |
| 3,913,048 | 10/1975 | Mertler | 337/67 |
| 3,913,053 | 10/1975 | Place | 337/347 |
| 3,943,479 | 3/1976 | Turner | 337/360 X |
| 4,052,591 | 10/1977 | Sekera et al. | 337/361 X |

*Primary Examiner*—R. L. Moses

*Attorney, Agent, or Firm*—Leonard J. Platt; George R. Powers; John F. Cullen

[57] ABSTRACT

Thermostats for use in electrically heated appliances have a positive off position and are adapted for transition to a low temperature on position within a small amount (approximately one radian) of control shaft rotation. The thermostats comprise a stacked blade assembly including a lower bimetal temperature responsive blade, an intermediate stiff spring blade and an upper less stiff flexible spring blade, with the spring blade having juxtaposed switch contacts thereon and the bimetal blade operating to separate the switch contacts when the set temperature is attained. A control bracket mounted above the stacked blade assembly defines an opening through which a control shaft extends, the control shaft butting against the stiff spring blade and positioning it. The shaft mounts a cam and the control bracket has a depending cam follower for the cam, wherein the spring blade urges the cam against the cam follower. The cam has an on/off transition portion which achieves the transition of the thermostat between its positive off position with the switch contacts separated and a low temperature positive on position with the switch contacts together at good contact pressure. In one embodiment the cam further comprises a temperature adjustment portion for adjusting temperature settings above the low temperature on position. In another embodiment the cam is comprised of a cam bushing which threadably receives the control shaft for temperature adjustment, and the cam bushing and cam shaft are locked together by clutch surfaces for rotating the cam bushing to achieve the off/on transition.

21 Claims, 12 Drawing Figures

THERMOSTAT WITH POSITIVE OFF POSITION

BACKGROUND OF THE INVENTION

This invention relates to thermostats for electrical appliances, and particularly thermostats having a positive off position.

Thermostats are used in a variety of electrically heated appliances, such as grills and griddles, frypans, waffle irons, cooking vessels, irons, and others. The function of the thermostat is to control the operation of an electrical heating element of the appliance in order to maintain a selected temperature. In order to accomplish this function in a highly satisfactory manner, the thermostat would most desirably have all of the following features and characteristics. It should be simple, inexpensive and reliable, and this is best accomplished through constructing the thermostat from a minimum number of parts which are easily assembled. The thermostat should be accurate, and accuracy is enhanced by good calibration characteristics. The thermostat should be compact, so as not to unduly increase the size and weight of the appliance. The thermostat should have a positive off position, i.e., a position in which the heating element of the appliance cannot be turned on by the thermostat regardless of the ambient temperature, thus eliminating the need for a separate off/on switch.

While various prior art thermostats have adequately met some of these criteria, none have achieved all of them, and there still remains a need for a better thermostat.

SUMMARY OF THE INVENTION

Accordingly,, a principal object of the present invention is to provide an improved thermostat for electrically heated appliances.

Another object of the present invention is to provide an improved thermostat for electrically heated appliances which incorporates a positive off setting.

A further object of the present invention is to provide an improved thermostat for electrically heated appliances which is accurate and reliable.

An additional object of the present invention is to provide an improved thermostat for electrically heated appliances which is comprised of a minimum number of parts, which is compact, and which is easy to assemble and calibrate.

Another principal object of the present invention is to provide an improved thermostat for electrically heated appliances which incorporates all of the foregoing features and characteristics.

The thermostats according to the invention herein comprise a bimetal blade, a first relatively stiff spring blade, a second more flexible spring blade and a control support bracket, these elements being stacked together at their first ends alternately with insulators and secured together. The stiff spring blade is intermediate the flexible spring blade and the bimetal blade, and the support bracket is spaced above the flexible blade. Switch contacts are respectively mounted juxtaposed on the stiff and flexible spring blades, and the bimetal blade mounts an insulated calibration screw which extends through an opening in the stiff spring blade toward the flexible spring blade such that the temperature responsive motion of the bimetal blade is transmitted to the flexible blade to open and close the switch contacts in response to temperature changes.

The position of the stiff spring blade is adjustably set by a control mechanism mounted to the support bracket. The control mechanism includes a control shaft, a knob for rotating the control shaft, and an insulating rod mounted to the control shaft and bearing against the stiff spring blade through an opening in the flexible spring blade. The control mechanism further comprises a cam mounted to the control shaft and cooperating with a cam follower mounted to (or an integral part of) the support bracket, whereby a small rotation of the control knob and shaft, on the order of one radian or less, drives the stiff spring blade away from the flexible spring blade to a positive off position, i.e., a position wherein the switch contacts are spaced apart without regard to the ambient temperature or action of the bimetal blade. The same small rotation of the control knob and shaft from the "off" position returns the stiff spring blade to an "on" position at a low temperature setting, and further rotation of the control knob and shaft adjusts the temperature at which the bimetal blade will open the switch contacts.

In one embodiment, the control shaft is threaded into a cam bushing which cooperates with a cam follower of the control support bracket to provide the transition between the positive off and the low temperature on positions, the control shaft and cam bushing being secured together during this rotational movement by means of a cone clutch. Once the cam has been rotated to the low temperature on position, the cone clutch releases and temperature adjustment over the operating range is achieved by means of the threaded interaction between the control shaft and the cam bushing. In another embodiment, the cam is fixed to the control shaft and bears against a cam follower mounted to the control support bracket. The cam has a first steep profile section for accomplishing transition between the positive off and the low temperature on positions, and a second less steep profile section for adjusting the temperature setting of the thermostat. In both embodiments, the stiff spring blade bearing against the control shaft holds the cam against the cam follower without additional supporting structure.

The use of the stiff spring blade to hold the control mechanism in its assembled, operative condition reduces the number of parts and complexity of the thermostat, resulting in a simple and reliable unit. The use of a cam to achieve a positive off position within a small amount of rotation of the control shaft leaves a substantial remainder of permissible rotation of the control shaft for adjusting the thermostat to operate at a desired temperature, and this together with the inherent feature of high switch contact pressure at low temperature settings aids in accurate calibration of the unit. The sharp transition between the positive off and low temperature on settings also provides a good "feel" to the operator of the thermostat, who can readily discern whether the appliance is off or on.

Other and more specific features and objects of the invention herein will in part be apparent and will in part appear from a perusal of the following description of the preferred embodiments and claims, taken together with the drawings.

DRAWINGS

The same reference numerals refer to the same elements throughout the various figures.

DESCRIPTION OF THE PREFERRED EMBODIMENTS

Figure 1:
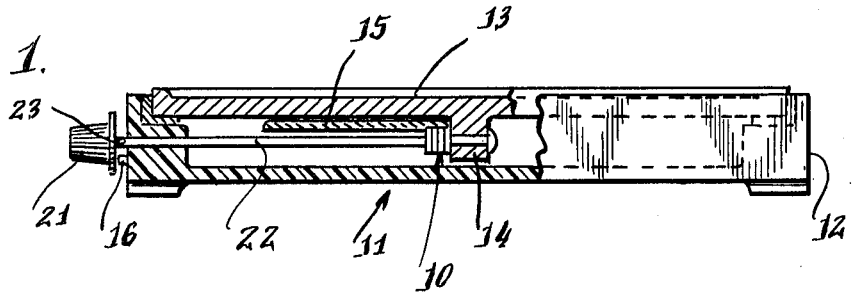
FIG. 1 is a side elevation view, partially in section, of a thermostat according to the invention herein mounted to an electrically heated grill.

Referring to FIG. 1, a thermostat 10 according to the invention herein is shown installed in a grill 11. The grill 11 comprises a base 12 supporting a metal heat-conductive cooking surface 13 which has a depending boss 14 extending downwardly from its underside. An electric resistance heating element 15 is deployed under the cooking surface 13, and when electric current is passed through the electric heating element it generates heat which is absorbed and spreads through the cooking surface 13 and is also conducted into the depending boss 14. The thermostat 10 may be mounted to the boss 14 by a heat pipe, not seen in FIG. 1, wherein the heat from the boss 14 is conducted efficiently to the thermostat 10. As will be more fully discussed below, the thermostat 10 includes switch contacts which intermittently operate the resistance heating element 15 in order to establish and maintain a desired cooking temperature which is set by selectively positioning knob 21 of a control mechanism 20 of the thermostat 10.

Figure 2:
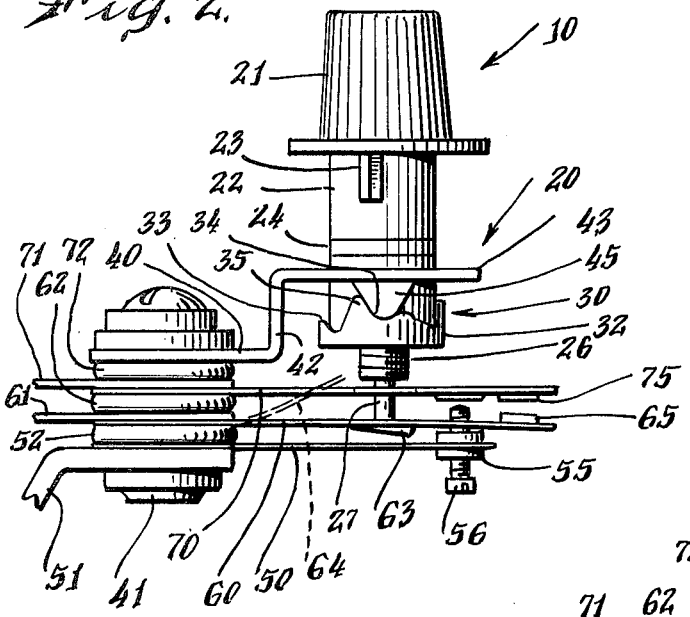
FIG. 2 is a side elevation view of a first embodiment of a thermostat according to the invention herein in its off position.

Referring now to FIG. 2, the thermostat 10 is shown in more detail. It is of the stacked blade type, and comprises a bimetal temperature responsive blade 50, a relatively stiff but yet flexible intermediate spring blade 60, and a less stiff flexible upper spring blade 70. The three blades 50, 60 and 70 are secured together in a sandwich configuration together with a support bracket 30, which is positioned above the flexible blade 70, and a heat pipe 51 which is positioned below and adjacent the bimetal blade 50 to transfer heat to it. The sandwich further includes conductive electrical terminals 61, 71 positioned adjacent and contacting the stiff spring blade 60 and flexible spring blade 70, respectively. The blades, support bracket, etc. are spaced apart and electrically insulated by ceramic insulators, and specifically ceramic insulator 52 is positioned between the bimetal blade 50 and the stiff spring blade 60, insulator 62 is positioned between terminal 61 associated with the stiff blade 60 and the flexible blade 70, and insulator 72 is interposed between terminal 71 associated with flexible blade 70 and the support bracket 30. A rivet 41 or other fastener is used to secure the foregoing elements together in the sandwich configuration, as shown.

Figure 3:
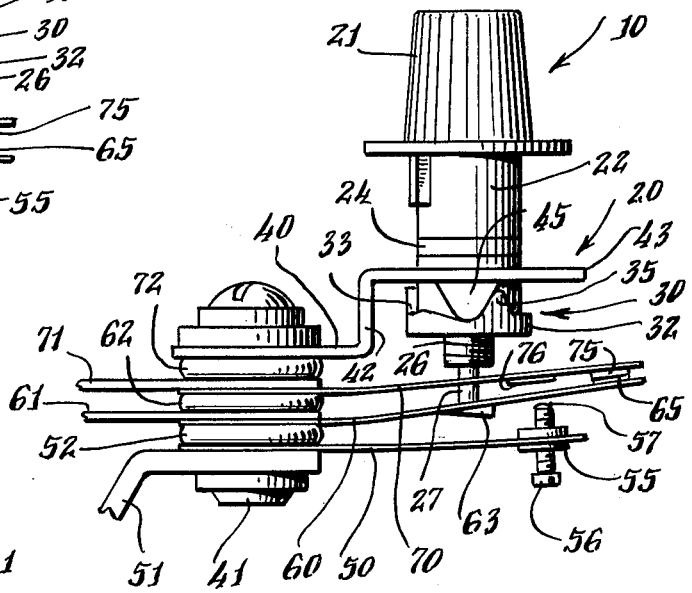
FIG. 3 is a side elevation view of the thermostat of FIG. 2 adjusted to a low temperature on position.

The spring blades 60 and 70 are provided, respectively, with facing juxtaposed electrical contacts 65 and 75. When the contacts 65 and 75 are closed, i.e., in contact with each other as shown in FIG. 3, they permit electrical current flow through the heating element 15 of the grill 10, which is wired in series with the terminals 61 and 71 and a source of electrical power. When the contacts 65 and 75 are open, as illustrated in FIG. 2, no current is permitted to flow through the heating element 15.

The bimetal blade 50 is provided with an insulator 55, which is mounted at the outer end thereof. The insulator 55 threadably mounts a calibration screw 56. The calibration screw extends through an opening 66 toward the flexible spring blade 70, which is preferably provided with an integrally stamped boss 76 for receiving the end 57 of the calibration screw 56 in butting relationship. When the bimetal blade 50 is heated, its free end carrying screw 56 bends upwardly toward the flexible blade 70 as shown in FIG. 4, and when the bimetal blade is sufficiently heated and hence bent, it presses against the blade 70 through the tip 57 of calibration screw 56 to open contacts 65 and 75, as shown in FIG. 5 and as more fully discussed below.

The thermostat 10 further comprises a control mechanism 20 for adjusting the temperature at which the thermostat will maintain the cooking surface 13 of grill 11. The control mechanism 20 also provides for a positive off condition of the thermostat 10 wherein the grill 11 cannot come on regardless of the ambient temperature surrounding it. The control mechanism comprises a knob 21 which is secured to or integral with a shaft 22, and the shaft 22 may be of any desired length required to position the knob 21 for manipulation. Knob 21 is provided with a stop 23 which cooperates with a stop 16 on the grill base 12 to limit rotation of the knob 21 and associated shaft 22 to less than 360 degrees, and preferably approximately 270 degrees or close to five radians.

Figure 4:
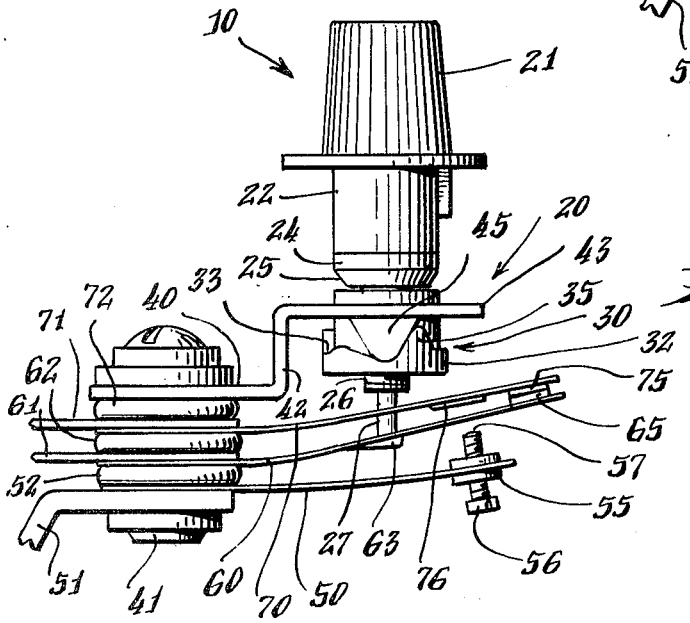
FIG. 4 is a side elevation view of the thermostat of FIG. 2 adjusted to a high temperature on position and showing the bimetal blade moving toward the flexible blade.
Figure 5:
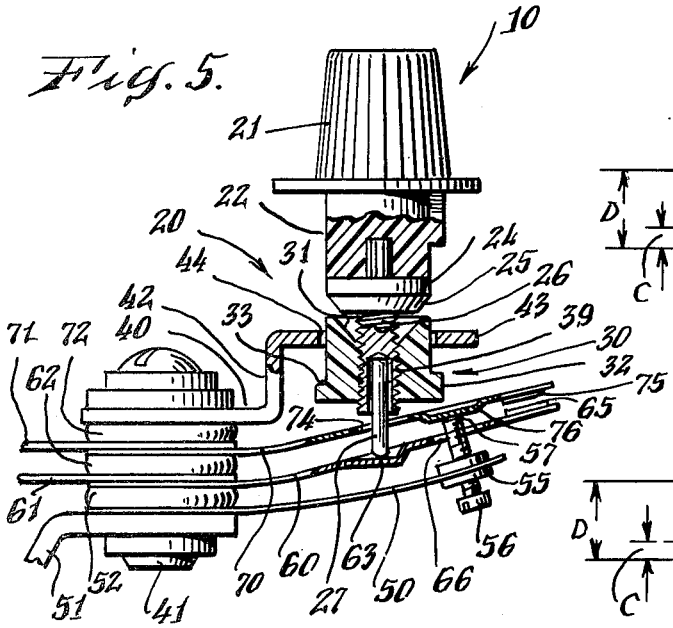
FIG. 5 is a sectional view of the thermostat of FIG. 2 adjusted to a high temperature on position similar to FIG. 4, but with the bimetal blade bent upward to separate the switch contacts.

The shaft 22 has secured thereto a cone clutch member 24 including conical clutch surface 25, best seen in FIGS. 4 and 5. Extending centrally downwardly from the cone clutch member 24 is a threaded adjustment screw 26. The adjustment screw 26 is threaded into a matingly threaded central opening 39 in a generally cylindrical cam bushing 30. The cam bushing 30 includes a conical clutch surface 31, best seen in FIG. 5, against which the conical clutch surface 25 of the cone clutch member 24 seats and frictionally engages when the adjustment screw 26 is turned all the way into the cam bushing 30.

Figure 6:
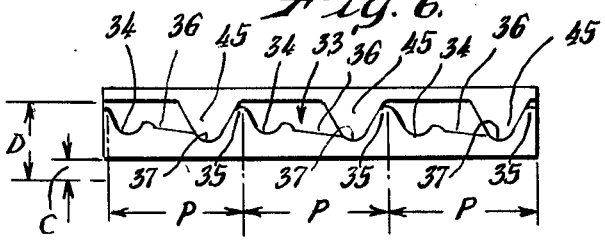
FIG. 6 is a diagrammatic view of the support bracket and its cam followers and the cam of the thermostat of FIG. 2 in an on position.
Figure 7:
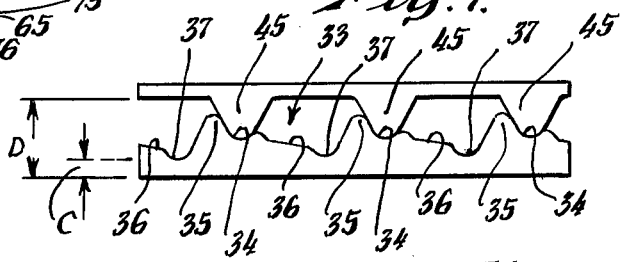
FIG. 7 is a diagrammatic view of the support bracket and its cam followers and the cam of the thermostat of FIG. 2 in its off position.

The cam bushing 30 includes a larger diameter circumferential flange 32 about its lower end, and the flange 32 defines a cam surface 33. The profile of the cam surface 33 is best seen in FIGS. 6 and 7, which are diagrammatic views wherein the flange 32 of the cam bushing is displayed as if it had been unrolled and placed flat on the drawing. It will be noted that the profile of cam surface 33 is a sub-profile P repeated three times about the cam bushing 30.

The support bracket 40, offset by leg 42 to provide clearance above flexible blade 70, includes a top leg 43 which extends generally parallel to the spring and bimetal blades. The top leg 43 defines an opening 44, best seen in FIG. 5, and three cam follower legs 45 depend downwardly adjacent the opening 44. One of the cam follower legs 45 is seen in FIGS. 2–5, and the other two cam follower legs are deployed at equal intervals about the opening 44. This is best seen in FIGS. 6 and 7, which diagrammatically show the three cam follower legs in plan view. The cam bushing 30 is received in the opening 44, and the cam follower legs 45 are engaged against the cam surface 33.

The lower end of the threaded adjustment screw 26 carries an insulating rod 27 which extends downwardly through an opening 74 in the flexible blade 70, the end of insulating rod 27 butting against the stiff spring blade 60. A dimpled portion 63 of blade 60 may be provided to receive the end of rod 27. The stiff spring blade 60 has a free position shown partially in the dotted lines 64 of FIG. 2, in which it extends upwardly toward the support bracket 40. Thus, the spring blade 60 is substantially deflected from its free position as it is shown in solid lines in FIG. 2, and exerts force on the end of the insulating rod 27. This force urges the entire control mechanism 20 upwardly with respect to the support bracket 40 and holds the control mechanism 20 firmly in place in its assembled, operative condition. In particular, the spring blade 60 urges the insulating rod 27 upwardly and holds it in the threaded adjustment screw 26, and because the adjustment screw 26 is threaded to the cam bushing 30, the cam bushing 30 is also urged upwardly. This maintains the cam surface 33 firmly engaged with the cam follower legs 45 of the support bracket 40. No other structure is required to hold the control mechanism 20 in place.

In FIG. 2, the thermostat 10 is in its positive off position. The cam follower legs 45 are received in first notches 34 of the cam surface 33, wherein the cam bushing 30 is spaced at its lowermost position from the support bracket 40, shown as distance D in FIG. 7. This position is achieved by rotating control knob 21 counterclockwise, wherein the adjustment screw 26 turns into the cam bushing 30 until the mating conical clutch surfaces 25 and 31 lock together. Further counterclockwise rotation of knob 21 turns the cam bushing 30 in a counterclockwise direction to seat the cam follower legs 45 in the first notches 34. The spikes 35 of the cam surface 33 butt against the sides of the cam follower legs 45 to stop rotation of the cam bushing 30 when the thermostat 10 is in its positive off position. Since the adjustment screw 26 is fully threaded into the cam bushing 30, the adjustment screw 26 also extends its maximum distance below cam bushing 30 and hence also from the support bracket 40, and, through rod 27, deflects spring blade 60 to its lowermost position. When the spring blade 60 is in its lowermost position, its contact 65 is separated from the contact 75 of flexible spring blade 70, which is in its free position in the positive off condition shown in FIG. 2. Thus, the contacts 65 and 75 are open, and the thermostat 10 is in a positive off position. Downward deflection of the bimetal blade 50, such as might be caused by extremely low ambient temperatures, does not produce any effect on either the spring blade 60 or flexible blade 70, and does not close the switch contacts.

Referring now to FIG. 3, the thermostat 10 is shown in an on position at a low temperature setting. This position is achieved by rotating the control knob 21 clockwise from the position shown in FIG. 2. Because the conical clutch surfaces 25 and 31 are frictionally locked together, rotation of the knob 21 in a clockwise direction also rotates the cam bushing 30, and the cam follower legs 45 slide over the inclined transition portion 36 of the cam surface 33 to second notches 37. As best seen by comparing FIGS. 6 and 7, this causes the cam bushing 30 to move upwardly by a distance C, and the stiff spring blade 60 also moves up the same distance, closing the contacts 65 and 75 and partially deflecting flexible blade 70 upward as well. When contacts 65 and 75 are closed, current flows to the registor heating element 15 of the grill 11, and the grill heats. The heat of the grill is transmitted to the bimetal blade 50 via the boss 14 and heat pipe 51, and in response to heating the bimetal blade 50 bends upwardly. In FIG. 3, the bimetal blade is shown deflecting slightly upwardly, but not yet causing the tip 57 of calibration screw 56 to contact the boss 76 of flexible spring blade 70. However, when the bimetal blade 50 is sufficiently heat deflected, the calibration screw 56 will deflect the flexible spring blade 70 upwardly to open switch contacts 65 and 75, stopping flow of current to the heating element 15. The calibration screw 56 is initially adjusted such that the bimetal blade 50 opens the switch contacts at the set temperature. As the grill surface 13 cools, the bimetal blade will also cool and deflect downwardly, permitting the flexible spring blade 70 to close switch contacts 65 and 75. In this manner, the thermostat 10 intermittently operates the heating element 15 to maintain the grill surface at the selected temperature, which in FIG. 3 is the low temperature on setting.

Referring now to FIG. 4, the thermostat 10 is shown at a high temperature setting selected by further rotation of control knob 21 in the clockwise direction. Because the cam follower legs 45 are seated in the second notches 36 and the spikes 35 prevent further clockwise rotation of the cam bushing 30, further clockwise rotation of the knob 21 separates the conical clutch surfaces 25 and 31 and backs off the adjustment screw 26 to raise the stiff blade 62 a higher position, as shown in FIG. 4. Thus, much greater temperature is required to deflect the bimetal blade 50 enough to cause the calibration screw 56 to contact blade 70 and separate the switch contacts 65 and 75, as shown in FIG. 5, and the thermostat 10 operates to maintain the grill at the higher selected temperature. Of course, intermediate temperatures are selected by positioning the control knob 21 between the low temperature on position shown in FIG. 3 and the high temperature on position of FIGS. 4 and 5.

In the preferred embodiment illustrated, approximately one radian of rotation of the control knob 21 is required for the transition between the positive off position shown in FIG. 2 and the low temperature on position of FIG. 3. When the adjusting screw is a $\frac{1}{4}$-28 double lead screw, the cam surface 33 provides in approximately one radian of rotation blade travel of blade 60 equal to approximately four radians of rotation of the adjustment screw 26. Thus, a substantial deflection of blade 60 is provided over a relatively short amount of rotation, far more than would be available through the adjustment screw 26 alone, wherein the positive off position may be achieved. The knob 21 is preferably limited to approximately 3.5–4 additional radians of rotation, the limitation being provided by the stop 16 engaging the stop 23 of knob 21, the stops being shown in FIG. 1. However, because the positive off function is separate from the temperature adjusting function of the adjustment screw 26, the adjustment screw 26 may be pitched to provide an extremely accurate temperature setting over the remaining available 3.5–4 radians of rotation. In particular, by use of this dual mechanical system, greater temperature to deflection operating range is available because the low end of the range can be depressed below room temperature, and a high activity bimetal blade 50 can be used. This also make calibration easier because greater mechanical motion is available per degree of temperature.

Also, the use of the cam bushing 30 assures that at the low temperature on setting the switch contacts 65 and 75 will not be just closed with almost zero contact pressure. The travel imparted to both spring blades 60 and 70 assures a substantial gap at the positive off position and substantial switch contact pressure at the low temperature on position.

A second thermostat 100 according to the invention herein is shown in FIGS. 8–12. The thermostat 100 can also be used in grill 11 or other electrically heated appliances. The stacked blade assembly of thermostat 100 is quite similar to that described above with respect to thermostat 10, and the same reference numerals, with the addition of an "a" suffix where the elements have minor differences, have been applied to the bimetal blade 50*a*, the stiff spring blade 60*a*, the flexible spring blade 70*a*, the terminals 61 and 71, ceramic insulators 52, 62 and 72, heat pipe 51, and the like. The support bracket 140 of thermostat 100 differs from the support bracket 40 of thermostat 10 in details which will become apparent in the following description.

Bimetal blade 50*a* is somewhat longer than bimetal blade 50, and is the same length as flexible spring blade 70*a*. Calibration screw 56 is threaded through flexible spring blade 70*a* and its tip 57 butts against insulator 52*a* at the tip of bimetal blade 50*a*. Stiff spring blade 60*a* is somewhat shorter than blade 60, and switch contacts 65 and 75 are repositioned as required. The operation of these elements, however, remains as described above.

The thermostat 100 further comprises a control mechanism 120 including a knob 121 secured to a shaft 122. The shaft 122 is rotatably mounted through a cam follower bushing 130 which includes a depending cam follower leg 135. The cam follower bushing 130 is disposed on the underside of the support bracket 140, and is held against rotation by depending tabs 141 and 142 which are received in slots 131 and 132, respectively, on the cam follower bushing. The support bracket 140 defines an opening 144 accommodating the shaft 122. The lower end of shaft 122 is stepped as indicated at 123, and a smaller diameter portion 124 extends downwardly toward the blades 50*a*, 60*a* and 70*a* of the thermostat 100. An insulating rod 27 is received in an axial opening formed in shaft 22, and insulating rod 27 extends through the opening 74 in flexible blade 70*a* and bears against the stiff spring blade 60*a*.

Figure 11:
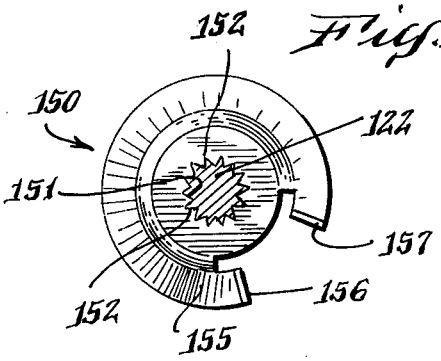
FIG. 11 is a top plan view of a cam of the thermostat of FIG. 8.

A cam 150 is secured to the end of shaft 22, and in particular, the cam 150 is shown in plan in FIG. 11 and includes a central opening 151 having peripherally disposed teeth 152. Thus, the cam 150 is pressed over the smaller diameter portion 124 of the shaft 122, and the teeth 152 securely mount the cam to the shaft 122, maintaining the cam 150 seated against the stepped flange 123.

Figure 8:
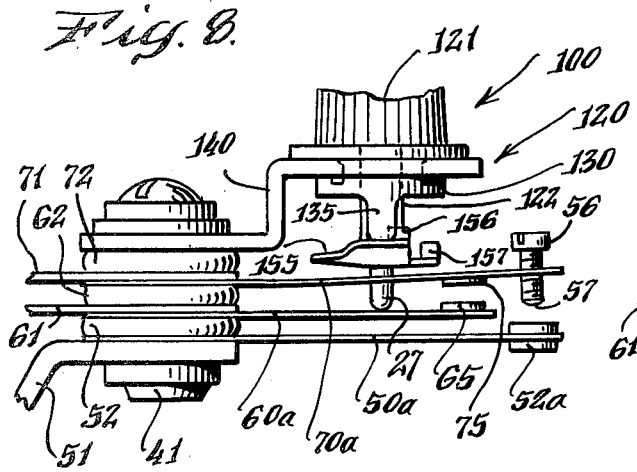
FIG. 8 is a side elevation view of another thermostat according to the invention herein shown in its off position.

The stiff spring blade 60*a* has a free position wherein it extends sharply upwardly toward the support bracket 140, and the stiff spring blade 60*a* is shown deflected downwardly from the free position in FIG. 8. Thus, the stiff spring blade 60*a* exerts an upward force on the insulating rod 27, which transfers the force to the shaft 122 and cam 150 securely mounted thereon. Thus, the cam 150 is held firmly against the cam follower leg 135 of the cam follower bushing 130, and the cam follower bushing itself is held snugly against the underside of the support bracket 140 with the tabs 141 and 142 engaged in the slots 131 and 132.

Figure 12:
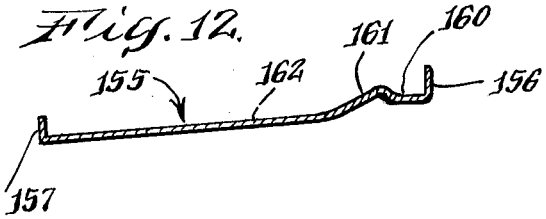
FIG. 12 is a diagrammatic view showing the profile of the cam of FIG. 11.

Referring now to FIGS. 11 and 12, details of the cam 150 are illustrated. In particular, the cam is generally circular when viewed in plan, and includes a cam surface indicated generally at 155 extending about its periphery between stops 156 and 157, which are merely upturned tabs. Approximately five radians of rotation are permitted between the stops 156 and 157, the rotation being limited by the engagement of the stops 156 and 157 with the depending cam follower leg 135. Referring now to FIG. 12, the profile of the cam surface 155 of cam 150 is shown, FIG. 12 being diagrammatic in that the cam profile is "unrolled" into a plan view. The cam surface 155 includes a notched portion 160 for receiving the cam follower leg 135 when the thermostat is in its positive off position. Immediately adjacent the off notch is a sharply inclined off-on transition portion 161, and the off-on transition portion 161 and the off notch 160 together comprise about one radian of the rotation of cam 150. An adjustment portion 162 comprises the remainder of cam surface 155, the adjustment portion 162 extending from the off-on transition portion 161 to the stop 157, and this portion of the cam surface 155 is less steeply inclined than the off-on transition portion 161.

Referring again to FIG. 8, the thermostat 100 is shown in its positive off position and in particular the cam follower leg 135 is seated in the off notch 160 of cam 150 wherein the shaft 122 and associated insulator rod 27 are held in their lowermost position with respect to support bracket 140, deflecting stiff spring blade 60*a* to provide positive separation of the switch contacts 65 and 75. It will be noted that the flexible blade 70*a* is in its free position and is not deflected to maintain the separation between the switch contacts 65 and 75, and further, the action of the bimetal blade 50*a* cannot cause the switch contacts 65 and 75 to close. The bimetal blade 50*a* is shown in a substantially straight position in FIG. 8, typical of ambient room temperatures.

Figure 9:
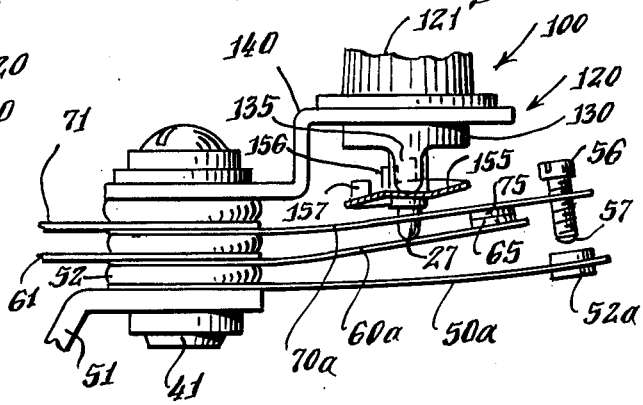
FIG. 9 is a side elevation view of the thermostat of FIG. 8 adjusted to a medium temperature on position.
Figure 10:
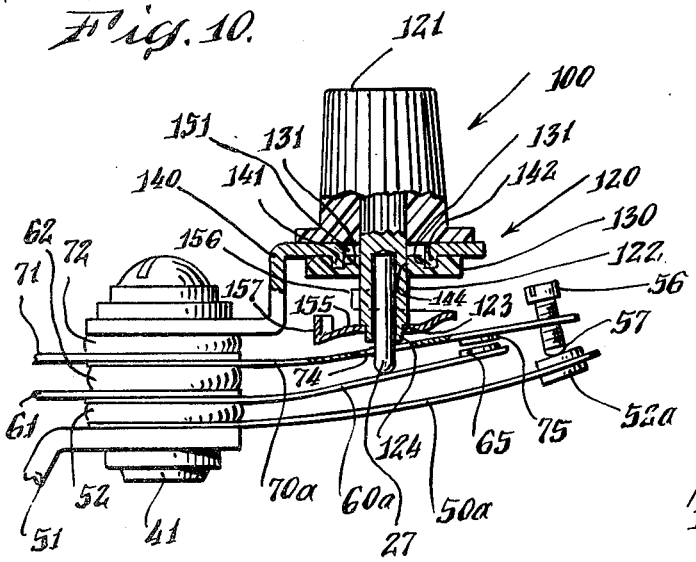
FIG. 10 is a side elevation view of the thermostat of FIG. 8 adjusted to a medium temperature on position similar to FIG. 9, but with the bimetal blade bent upward to open the switch contacts.

Referring now to FIG. 9, the control knob 121 of the control mechanism 120 has been rotated approximately three radians counterclockwise with respect to the positive off position shown in FIG. 8, wherein the thermostat 100 is set to an intermediate temperature. It will be noted that the control mechanism 120 and particularly the shaft 122 and insulating rod 27 have been shifted upwardly by virtue of the position of cam 150 shown in FIG. 9. The stiff spring blade 60*a* is, therefore, inclined upwardly toward the support bracket 140, carrying the flexible spring blade 70*a* therewith. The contacts 65 and 75 are closed to provide current to the electric heating element 15 of the grill 11, or other electrically heated appliance in which the thermostat 100 is installed. In FIG. 9, the bimetal blade 50*a* is not yet bent sufficiently far to open the switch contacts 65 and 75, but after a sufficient amount of heat has been supplied to bring the grill to the desired set temperature, the bimetal blade 50a will open the switch contacts 65 and 75 to stop current flow to the heating element 15. Thus, in FIG. 10, the thermostat 100 is shown adjusted to the same temperature setting as in FIG. 9. However, the temperature of the grill has risen sufficiently to cause bimetal blade 50 to bend, and separate the contacts 65 and 75. The thermostat will continue to cycle on and off to maintain the desired temperature.

In the transition of the thermostat 100 from the positive off position shown in FIG. 8 to the low temperature on position, not shown, the cam follower leg 135 traverses the sharply inclined portion 161 of cam surface 155, resulting in substantial vertical travel of the insulating rod 27 and positive contact is between the switch contacts 65 and 75 in the low temperature on position. As in thermostat 10 described above, this is achieved over a small portion of the permissible rotation of the control knob 121, leaving a substantial remainder of permissible rotation for adjusting the operating temperature. Therefore, the thermostat 100 achieves the same benefits as described above with respect to thermostat 10, and in particular, is easy to calibrate, is accurate over the temperature range, and permits use of a high activity bimetal blade 50a.

Both of the thermostats 10 and 100 have an excellent "feel" in their operation, in that the transition to the positive off position is rapid and solid providing an easily discerned knowledge as to whether the thermostat is off or on. Both thermostats are characterized by a minimum number of parts, in that the stiff blades 60 and 60a serve the dual function of holding the parts in their operative relationship and also positioning switch contact 65.

The thermostats 10 and 100 admirably satisfy the objects of the invention, and it will be appreciated that changes in the structure of the preferred embodiments described above can be made without departing from the spirit and scope of the invention, which is limited only by the claims.

I claim:

1. A thermostat comprising:

(A) a stacked blade assembly including (1) a lower temperature responsive bimetal blade, (2) a conductive intermediate stiff spring blade, and (3) a conductive upper flexible spring blade which is less stiff then the stiff spring blade, first ends of the blades spaced apart by interposed insulators and the first ends of the blades and the insulators secured together in the sandwich configuration, the conductive spring blades having a pair of juxtaposed switch contacts thereon and adapted for connection in an electrical circuit, and one of the bimetal blade or the flexible spring blade having a stop member for butting against the other to transmit heat responsive motion of the free end of the bimetal blade to the flexible spring blade; and (B) a control mechanism including (1) a control bracket mounted to the stacked blade assembly and extending generally parallel to and above the upper flexible spring blade when it is in its free position, the control bracket defining an opening therethrough above and intermediate the ends of the stacked blade assembly, (2) a rotatable control shaft extending through the control bracket opening and also through an opening defined by the upper flexible spring blade, the end of the control shaft bearing against the intermediate stiff spring blade, (3) a cam mounted to the control shaft for rotatable movement therewith, the cam interposed between the upper flexible spring blade and the control bracket and having a cam surface facing the control bracket, and (4) a cam follower depending from the control bracket adjacent the control shaft for engaging the cam surface wherein the intermediate stiff spring blade has a free position extending upwardly toward the control bracket and is deflected from the free position by the control shaft, the stiff spring blade thereby urging the control shaft and the cam mounted thereto upwardly to engage and hold the cam against the cam follower, and the cam surface comprises an on/off transition portion, whereby rotation of the control shaft moves the cam along the cam follower between a positive off position in which the cam follower, cam and control shaft deflect the stiff blade to separate the pair of switch contacts with the flexible spring blade in its free position and a low temperature on position in which the stiff blade is angled upwardly to close the pair of switch contacts, the bimetal blade operating to open the switch contacts when the low temperature is achieved.

2. A thermostat as defined in claim 1 wherein the cam provides sufficient movement of the control shaft in the transition between the positive off to the low temperature on position that the stiff spring blade deflects the flexible spring blade from its free position in the low temperature on position, whereby there is substantial contact pressure between the pair of switch contacts in the low temperature on position.

3. A thermostat as defined in claim 1 wherein the transition between the positive off position and the low temperature on position occurs in approximately one radian of rotation of the control shaft.

4. A thermostat as defined in claim 1 wherein the cam surface further comprises an adjustment portion, the adjustment portion permitting greater deflection of the spring blade as the control shaft is rotated away from the positive off position to set the thermostat to operate at selected temperatures above the low temperature on position.

5. A thermostat as defined in claim 4 wherein rotation of the control shaft and the cam mounted thereto is limited to approximately five or less radians, and wherein one radian of rotation achieves the transition between the positive off position and the low temperature on position, and the remaining four or less radians achieve adjustment of the thermostat to selected temperatures above the low temperature on position.

6. A thermostat as defined in claim 5 wherein the cam surface partially surrounds the control shaft and has end limit stops which butt against the cam follower to limit rotation of the control shaft and cam to approximately five or less radians.

7. A thermostat as defined in claim 6 wherein the off/on transition portion of the cam surface defines a notch adjacent one of the limit stops, the notch receiving the cam follower in the positive off position and the off/on transition portion of the cam surface extends between the notch and the adjustment portion of the cam surface.

8. A thermostat as defined in claim 4 wherein the cam follower is an integral part of a cam follower bushing defining an opening therethrough, the cam follower bushing mounted to and below the control bracket with the bushing opening generally aligned with the opening in the control bracket, and the control shaft is rotatably mounted in the cam follower bushing opening and extends through the control bracket opening.

9. A thermostat as defined in claim 8 wherein the cam follower bushing defines openings adjacent the control bracket in which are received protrusions depending from the underside of the control bracket, the engagement of the control protrusions in the openings limiting the cam follower bushing from rotation with respect to the control bracket to hold the cam follower in a fixed position.

10. A thermostat as defined in claim 1 wherein the cam comprises a cam bushing having a cam surface formed thereon, and the control shaft is threaded and threadably received through the cam bushing to mount the cam to the control shaft, and further comprising means for releasably locking the cam to the control shaft such that the rotation of the control shaft rotates the cam to accomplish the transition between the positive off position and the low temperature on position, the releasable locking means releasing the control shaft in the low temperature on position such that rotation of the control shaft in the cam bushing achieves adjustment of the thermostat to selected temperatures above the low temperature on position.

11. A thermostat as defined in claim 10 wherein the releasable locking means comprises clutch surfaces defined on the control shaft and the cam bushing, engagement of the clutch surfaces locking the cam to the rotatable shaft.

12. A thermostat as defined in claim 11 wherein the clutch surfaces are mating conical clutch surfaces.

13. A thermostat as defined in claim 10 wherein the cam surface defines stops for engaging the cam follower to limit rotation of the cam between the positive off and the low temperature on position.

14. A thermostat as defined in claim 10 wherein the cam surface comprises three off/on transition portions deployed about the cam bushing and the cam follower comprises three cam followers depending from the mounting bracket, each cam follower engaged with one of the off/on transition portions of the cam surface.

15. A thermostat as defined in claim 14 wherein the cam followers are integral depending tabs of the control bracket deployed surrounding the opening therein.

16. A thermostat as defined in claim 10 wherein the transition between the positive off position and the low temperature on position is achieved in approximately one radian of rotation of the control shaft and cam bushing releasably locked thereto.

17. A thermostat as defined in claim 10 wherein the control shaft is limited to approximately five or less radians rotation, rotation through approximately one radian accomplishing the transition between the positive off position and the low temperature on position, and rotation through the remaining four or less radians accomplishing adjustment of the thermostat to selected temperatures above the low temperature on position.

18. A thermostat comprising:

(A) a stacked blade assembly including (1) a lower temperature responsive bimetal blade, (2) a conductive intermediate stiff spring blade, and (3) a conductive upper flexible spring blade which is less stiff then the stiff spring blade, first ends of the blades spaced apart by interposed insulators and the first ends of the blades and the insulators secured together in the sandwich configuration, the conductive spring blades having a pair of juxtaposed switch contacts thereon and adapted for connection in an electrical circuit, and one of the bimetal blade or the flexible spring blade having a stop member for butting against the other to transmit heat responsive motion of the free end of the bimetal blade to the flexible spring blade; and (B) a control mechanism including (1) a control bracket mounted to the stacked blade assembly and extending generally parallel to and above the upper flexible spring blade when it is in its free position, the control bracket defining an opening therethrough above and intermediate the ends of the stacked blade assembly, (2) at least one cam follower depending from the control bracket adjacent the opening defined therethrough, (3) a cam bushing defining a cam surface, the cam bushing rotatably received adjacent the cam follower with the cam surface engaged therewith, the cam surface comprising an on/off transition surface and including stops limiting rotation of the cam at either end of the on/off transition surface, the cam bushing further defining a threaded opening extending axially therethrough and a clutch surface extending radially outwardly from the threaded opening, (4) a control shaft threadably mounted through the cam bushing and extending through an opening defined by the upper flexible spring blade to engage the stiff spring blade, the stiff spring blade having a free position angled upwardly toward the control bracket and the control shaft deflecting it downwardly, wherein the shaft is biased upwardly to urge the cam against the cam follower, the control shaft having a clutch surface opposite the clutch surface of the cam bushing, wherein the control shaft threadably rotates in the cam bushing until the clutch surfaces lock together, and the cam bushing and the control shaft rotate together when the clutch surfaces lock together whereby rotation of the control shaft with the cam bushing locked thereto causes cam surface to follower motion providing a transition between a positive off position wherein the stiff blade is deflected downwardly to separate the pair of switch contacts with the flexible blade in its free position, and a low temperature on position wherein the stiff blade is angled upwardly such that the pair of switch contacts are closed, and rotation of the shaft in the threaded cam bushing with the clutch surfaces unlocked further permits angular deflection of the spring blade to set the thermostat operating temperature above the low temperature on position.

19. A thermostat as defined in claim 18 wherein the rotatable shaft is limited to approximately five or less radians of rotation, approximately one radian of rotation being with the cam bushing and control shaft locked together and providing the transition between the positive off and low temperature on position of the thermostat, and the remaining four or less radians of rotation providing adjusted operating temperature settings above the low temperature on position.

20. A thermostat as defined in claim 19 wherein the cam bushing is cylindrical and includes a radially extending flange defining the cam surface facing the control bracket, the cam surface comprising three identical off/on transition portions deployed at equal intervals about the cam bushing, and the cam follower comprises three cam follower tabs integrally depending from the control bracket, one cam follower tab engaging each off/on transition portion, and the off/on transition portions of the cam surface are separated by cam surface spikes which engage the cam follower to limit rotation of the cam bushing to approximately one radian.

21. A thermostat as defined in claim 20 wherein each of the three off/on portions of the cam surface includes notches adjacent the spikes, the notches receiving the cam follower in a detent retaining manner when the thermostat is in its positive off position and when the thermostat is in its low temperature on position.

* * * * *